US007679912B1

(12) United States Patent
Xiong et al.

(10) Patent No.: US 7,679,912 B1
(45) Date of Patent: Mar. 16, 2010

(54) HEAT SINK ASSEMBLY HAVING HEAT PIPE

(75) Inventors: Hai-Gang Xiong, Shenzhen (CN); Zhi-Yong Zhou, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/329,611

(22) Filed: Dec. 7, 2008

(51) Int. Cl.
*H05K 7/20* (2006.01)
*F28D 15/00* (2006.01)

(52) U.S. Cl. ..... 361/700; 165/104.33

(58) Field of Classification Search ..... 165/104.33; 361/700

See application file for complete search history.

(56) References Cited

U.S. PATENT DOCUMENTS 7,451,806 B2 * 11/2008 Zhou et al. ..... 165/104.33
2007/0095507 A1 * 5/2007 Henderson et al. ..... 165/104.26
2007/0215321 A1 * 9/2007 Yang et al. ..... 165/80.3
2008/0075528 A1 * 3/2008 Marzetta ..... 403/238
2008/0128898 A1 * 6/2008 Henderson et al. ..... 257/713
2009/0040154 A1 * 2/2009 Scheibe ..... 345/83
2009/0080160 A1 * 3/2009 Wu ..... 361/704
2009/0107653 A1 * 4/2009 Jiang et al. ..... 165/80.3
2009/0146172 A1 * 6/2009 Pumyea ..... 257/99
2009/0159252 A1 * 6/2009 Lai et al. ..... 165/171
2009/0166000 A1 * 7/2009 Lai et al. ..... 165/80.3
2009/0194252 A1 * 8/2009 LEE et al. ..... 165/67

* cited by examiner

*Primary Examiner*—Gregory D Thompson
(74) *Attorney, Agent, or Firm*—Frank R. Niranjan

(57) ABSTRACT

A heat sink assembly includes a first heat dissipating plate, a second heat dissipating plate, at least one flat heat pipe horizontally positioned between the first heat dissipating plate and the second heat dissipating plate. The at least one flat heat pipe surrounds or defines an enclosed-space. The enclosed-space is closed by the first heat dissipating plate and the second heat dissipating plate. At least one through hole communicates with the enclosed-space and is defined in the second heat dissipating plate.

20 Claims, 2 Drawing Sheets

HEAT SINK ASSEMBLY HAVING HEAT PIPE

BACKGROUND OF THE INVENTION

1. Field of the Invention

The present invention relates to heat sink assembly and, particularly, to a heat sink assembly having a heat pipe.

2. Description of Related Art

Heat sinks are usually used to remove heat from electronic heat-generating components, such as central processing units (CPUs), to maintain the components within a certain temperature range for stable operation. A typical heat sink includes a base contacting an electronic heat-generating component to absorb heat generated thereby, a number of parallel fins attached to the base, and a heat pipe for transferring the heat from the base to the fins. An evaporator of the heat pipe is thermally connected to the base, and a condenser of the heat pipe passes through the fins. The base, the heat pipe, and the fins are generally manufactured individually, and assembled together to obtain the heat sink. During manufacture, the heat sink may be contaminated or oxidized, and require surfaces to be treated using a chemical solution.

In order to accommodate various requirements of the heat dissipation, the heat pipe in the heat sink may take on various shapes. For example, two U-shaped heat pipes may be provided in the heat sink, with each U-shaped heat pipe defining an opening. The opening of one U-shaped heat pipe faces the opening of the other U-shaped heat pipe, so that the two U-shaped heat pipes cooperatively define an enclosed-space. After the surface treatment process, the chemical solutions may remain in the enclosed-space of the heat sink. As a result, the trapped chemical solutions may flow out, thereby degrading the heat dissipating performance of the heat sink.

What is needed, therefore, is a heat sink assembly having a heat pipe which can overcome the above-described problems.

Advantages and novel features will become more apparent from the following detailed description when taken in conjunction with the accompanying drawings.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION OF THE EMBODIMENTS

Figure 1:
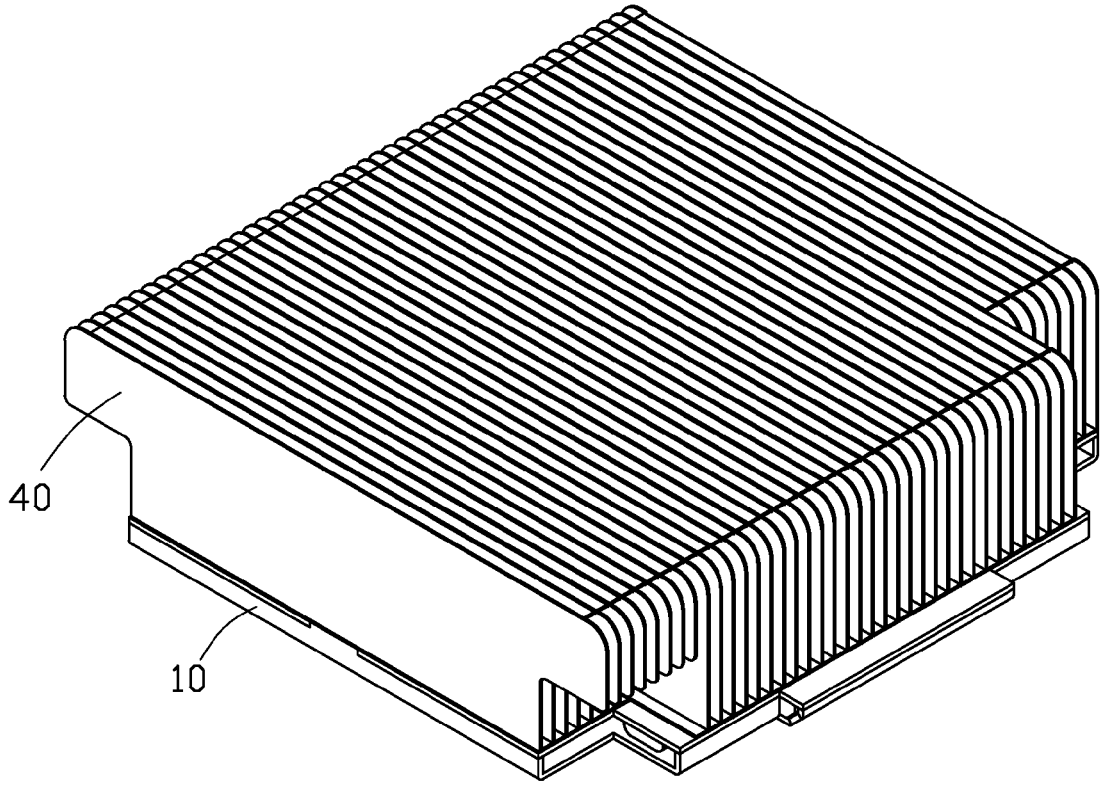
FIG. 1 is an assembled view of a heat sink assembly in accordance with an embodiment of the present disclosure.
Figure 2:
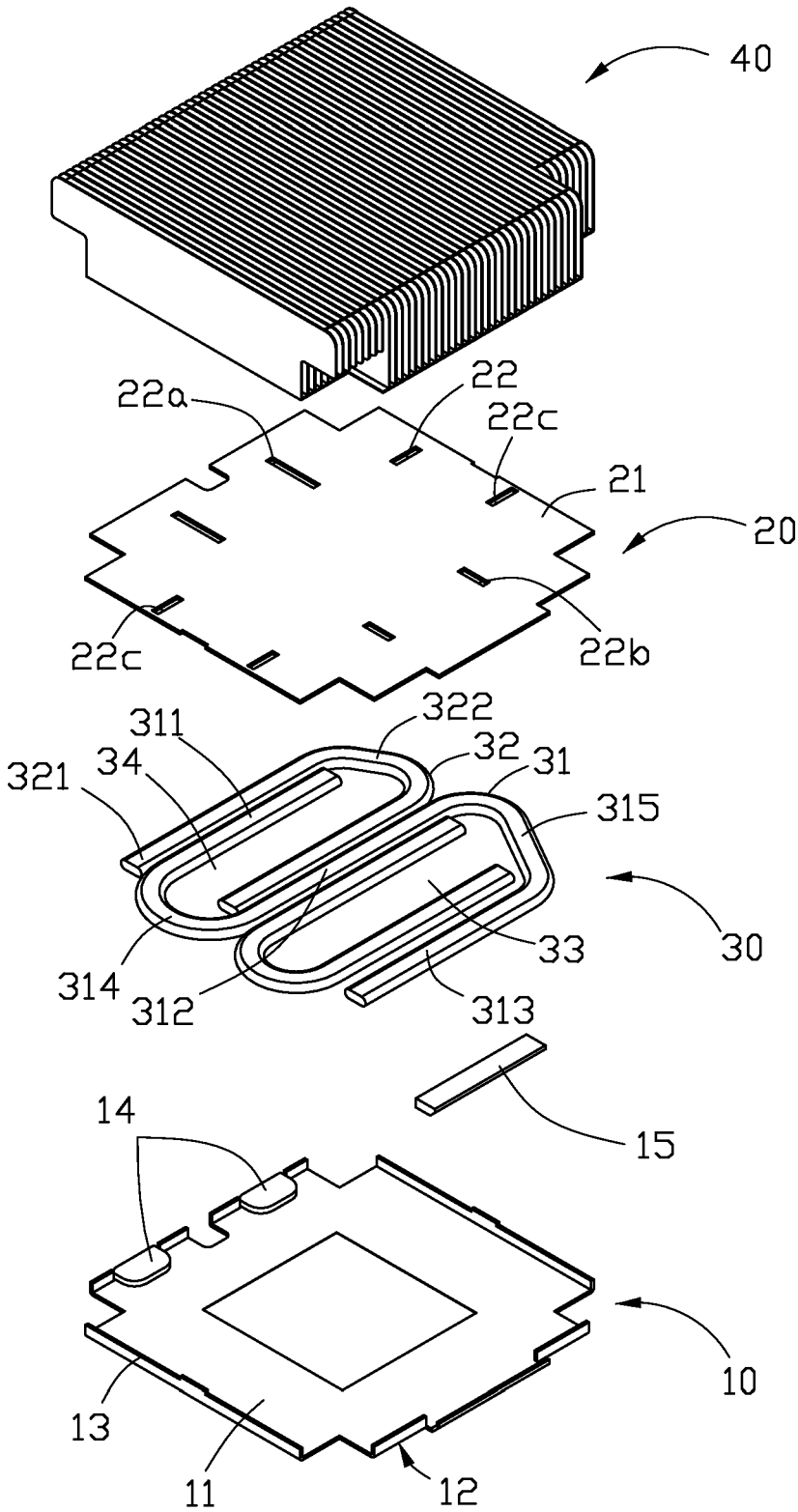
FIG. 2 is an isometric, exploded view of the heat sink assembly shown in FIG. 1.

Referring to FIG. 1 and FIG. 2, an embodiment of a heat sink assembly includes a first heat dissipating plate 10, a second heat dissipating plate 20, a heat pipe module 30, and a plurality of fins 40. The first heat dissipating plate 10 is configured to thermally connect with an electronic heat-generating device (not shown). The heat pipe module 30 is sandwiched between the first and second heat dissipating plates 10, 20. The fins 40 are attached to the second heat dissipating plate 20. The first heat dissipating plate 10, the second heat dissipating plate 20, the heat pipe module 30, and the fins 40 are made of a thermally conductive material such as copper, aluminum, an alloy thereof, and so on.

The first heat dissipating plate 10 is an integral structure and includes a top surface 11, a bottom surface 12, a sidewall 13 extending from an edge of the top surface 11, a first reinforcing portion 14, and a second reinforcing portion 15. The top surface 11 supports the heat pipe module 30. The bottom surface 12 thermally contacts the electronic heat-generating device. The sidewall 13 supports the second heat dissipating plate 20. The first and second reinforcing portions 14, 15 are arranged between the first and second heat dissipating plates 10, 20 so that the heat pipe module 30 is tightly and stably sandwiched between the first and second heat dissipating plates 10, 20. The first reinforcing portion 14 protrudes from the top surface 11 of the first heat dissipating plate 10, and the second reinforcing portion 15 is detachably sandwiched between the first and second heat dissipating plates 10, 20.

In the illustrated embodiment, the first reinforcing portion 14 includes two spaced blocks protruding from an edge of the top surface 11 and contacting the sidewall 13. The second reinforcing portion 15 may be an elongated plate arranged opposite to the first reinforcing portion 14. A height of each of the first and second reinforcing portions 14, 15 is equal to or slightly larger than a height of the sidewall 13, to strengthen the binding of the first and second heat dissipating plates 10, 20.

The second heat dissipating plate 20 includes a first surface and a second surface opposing the first surface. The heat pipe module 30 is sandwiched between the top surface 11 of the first heat dissipating plate 10 and the first surface of the second heat dissipating plate 20. The fins 40 are attached to the second surface of the second heat dissipating plate 20 such that the fins 40 extend substantially perpendicularly from the second surface of the second heat dissipating plate 20.

The heat pipe module 30 includes at least one flat heat pipe horizontally positioned on the top surface 11 of the first heat dissipating plate 10. The at least one heat pipe defines or surrounds at least one enclosed-space. In the illustrated embodiment, the heat pipe module 30 includes an S-shaped heat pipe 31 and two U-shaped heat pipes 32. The S-shaped heat pipe 31 defines two openings, and each of the two U-shaped heat pipes 32 defines an opening. The openings of the two U-shaped heat pipes 32 are respectively arranged opposite to the two openings of the S-shaped heat pipe 31 such that the S-shaped heat pipe 31 and the two U-shaped heat pipes 32 cooperatively define a first enclosed-space 33 and a second enclosed-space 34. A height of each of the S-shaped heat pipe 31 and the two U-shaped heat pipes 32 is substantially equal to a height of the sidewall 13.

A structure and a size of the second heat dissipating plate 20 correspond to a structure and a size of the first heat dissipating plate 10. The second heat dissipating plate 20 includes a plate body 21 with a plurality of through holes 22 defined therein. The through holes 22 defined in the plate body 21 communicate with the first and second enclosed-spaces 33, 34. As a result, after the heat sink assembly has been surface treated (e.g., cleaned), chemical solutions inevitably remained in the first and second enclosed-spaces 33, 34 can flow out through the through holes 22 to avoid corroding the heat sink assembly.

In order to better understand the position and size relationships between the through holes 22 defined in the second heat dissipating plate 20 and the first and second enclosed-spaces 33, 34 defined in the heat pipe module 30, the heat pipe module 30 and the second heat dissipating plate 20 are described below.

The S-shaped heat pipe 31 includes a first straight section 311, a second straight section 312, a third straight section 313, a first curving portion 314, and a second curving portion 315. The three straight sections 311, 312, 313 are parallel to each other, and the second straight section 312 is positioned between the first and third straight sections 311, 313. Each of the two U-shaped heat pipes 32 includes two parallel straight arms 321 and a connection portion 322 interconnected between the two straight arms 321.

One U-shaped heat pipe 32 is positioned between the second straight section 312 and the third straight section 313 of the S-shaped heat pipe 31. One straight arm 321 of the one U-shaped heat pipe 32 is parallel with and contacting the second straight section 312, and the other straight arm 321 of the one U-shaped heat pipe 32 is parallel with and spaced from the third straight section 313. In this manner, the one U-shaped heat pipe 32 and the second and third straight sections 312, 313 of the S-shaped heat pipe 31 cooperatively define the first enclosed-space 33.

The two straight arms 321 of the other U-shaped heat pipe 32 are parallel with and contacting the first and second straight sections 311, 312 of the S-shaped heat pipe 31 respectively. As a result, the first straight section 311 of the S-shaped heat pipe 31 is located between the two straight arms 321 of the other U-shaped heat pipe 32. In this manner, the other U-shaped heat pipe 32 and the first, second straight sections 311, 312 of the S-shaped heat pipe 31 cooperatively define the second enclosed-space 34.

For example, the second heat dissipating plate 20 defines eight through holes 22 communicating with the first and second enclosed-spaces 33, 34. The eight through holes 22 includes two first through holes 22*a*, two second through holes 22*b*, and four third through holes 22*c*.

The two first through holes 22*a* are located in the second heat dissipating plate 20 corresponding to the first straight section 311 and the straight arm 321 contacting the first straight section 311. The two first through holes 22*a* intersect and are substantially perpendicular to the first straight section 311 and the straight arm 321 contacting the first straight section 311. A diameter of each of the two first through holes 22*a* is larger than a total width of the first straight section 311 and the straight arm 321 contacting the first straight section 311. In the illustrated embodiment, each of the two first through holes 22*a* is rectangular-shaped, and a length thereof is larger than the total width of the first straight section 311 and the straight arm 321 contacting the first straight section 311. Thus, each of the two first through holes 22*a* communicates with the second enclosed-space 34.

The two second through holes 22*b* are located in the second heat dissipating plate 20 corresponding to the straight arm 321 near the third straight section 313. The two second through holes 22*b* intersect and are substantially perpendicular to the straight arm 321 near the third straight section 313. A diameter of each of the two second through holes 22*b* is larger than a width of the straight arm 321 near the third straight section 313. In the illustrated embodiment, each of the two second through holes 22*b* is rectangular-shaped, and a length thereof is larger than the width of the straight arm 321 near the third straight section 313. Thus, each of the two second through holes 22*b* communicates with the first enclosed-space 33.

The four third through holes 22*c* are located in the second heat dissipating plate 20 corresponding to the first and second curving portions 314, 315 and the connection portion 322. A diameter of each of the four third through holes 22*c* is larger than a width of the corresponding curving portion 314, 315 or connection portion 322. In the illustrated embodiment, each of the four third through holes 22*c* is rectangular-shaped, and a length thereof is larger than the width of the corresponding curving portion 314, 315 or connection portion 322. Thus, each of the four third through holes 22*c* communicates with the first enclosed-space 33 or the second enclosed-space 34.

It is to be understood that the structure, shape, size, and the number of the through holes 22 may vary, so long as the through holes 22 can communicate with the first and second enclosed-spaces 33, 34.

Alternatively, the first heat dissipating plate 10 can also defines a number of through holes 22 communicating with the first and second enclosed-spaces 33, 34. In addition, both of the first and second heat dissipating plates 10, 20 may define a number of through holes 22 communicating with the first and second enclosed-spaces 33, 34.

The S-shaped heat pipe 31 and two U-shaped heat pipes 32 are assembled according to the above-described manner to form the first and second enclosed-spaces 33, 34. The S-shaped heat pipe 31 and two U-shaped heat pipes 32 are fixed on the top surface 11 of the first heat dissipating plate 10, such as by adhering, soldering, fastening, or a combination thereof. The second heat dissipating plate 20 is positioned on the sidewall 13 of the first heat dissipating plate 10, so that the second heat dissipating plate 20 contacts the heat pipe module 30 and the first and second reinforcing portions 14, 15. The second heat dissipating plate 20 is secured to the sidewall 13 such as by adhering, soldering, fastening, or a combination thereof. Thus, the heat pipe module 30 is tightly sandwiched between the first and second heat dissipating plates 10, 20 due to the first and second reinforcing portions 14, 15. The fins 40 are secured to the second heat dissipating plate 20, such as by adhering, soldering, fastening, or a combination thereof.

The first and second enclosed-spaces 33, 34 of the heat pipe module 30 are enclosed by the first and second heat dissipating plates 10, 20, whereas the through holes 22 defined in the second heat dissipating plates 20 communicate with the first and second enclosed-spaces 33, 34. After the heat sink assembly has been surface treated (e.g., cleaned), chemical solutions remaining in the first and second enclosed-spaces 33, 34 can flow out through the through holes 22, thereby avoiding corroding the heat sink assembly.

It is believed that the present embodiments and their advantages will be understood from the foregoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. A heat sink assembly adapted for dissipating heat generated by an electronic heat-generating device, the heat sink assembly comprising:

a first heat dissipating plate having a top surface and a bottom surface thermally contacting the heat generating electronic device;

a second heat dissipating plate having a first surface and a second surface opposite the first surface;

a heat pipe module sandwiched between the top surface of the first heat dissipating plate and the first surface of the second heat dissipating plate, the heat pipe module comprising a first heat pipe and a second heat pipe, the first and second heat pipes cooperatively defining an enclosed-space, wherein the enclosed-space is enclosed by the top surface of the first heat dissipating plate and the first surface of the second heat dissipating plate; and a plurality of through holes communicating with the enclosed-space being defined in at least one of the first heat dissipating plate and the second heat dissipating plate.

2. The heat sink assembly as claimed in claim 1, wherein the first heat pipe is an S-shaped heat pipe, and the second heat pipe of the heat pipe module is a first U-shaped heat pipe, the S-shaped heat pipe has two opposite recessed sides defining two openings, the first U-shaped heat pipe has a recessed side defining an opening, the recessed side of the first U-shaped heat pipe faces one of the two opposite recessed sides of the S-shaped heat pipe with the opening of the first U-shaped heat pipe communicating with one of the two openings of the S-shaped heat pipe to define the enclosed-space.

3. The heat sink assembly as claimed in claim 2, wherein the heat pipe module further comprises a second U-shaped heat pipe having a recessed side defining an opening, and the recessed side of the second U-shaped heat pipe faces the other one of the two opposite recessed sides of the S-shaped heat pipe with the opening of the second U-shaped heat pipe communicating with the other opening of the two openings of the S-shaped heat pipe to define an additional enclosed-space.

4. The heat sink assembly as claimed in claim 3, wherein the S-shaped heat pipe comprises a first straight section, a second straight section, a third straight section, a first curving portion interconnected between the first and second straight sections, and a second curving portion interconnected between the second and third straight sections, each of the first and second U-shaped heat pipes comprises two straight arms and a connection portion interconnected between the two straight arms, and the first and second straight sections of the S-shaped heat pipe respectively are substantially parallel to and contact the two straight arms of the first U-shaped heat pipe.

5. The heat sink assembly as claimed in claim 4, wherein the second U-shaped heat pipe is positioned between the second straight section and the third straight section of the S-shaped heat pipe, one arm of the second U-shaped heat pipe is substantially parallel to and contacts the second straight section, and the other arm of the second U-shaped heat pipe is substantially parallel to and spaced from the third straight section.

6. The heat sink assembly as claimed in claim 5, wherein the through holes comprise a first through hole corresponding to the first straight section of the S-shaped heat pipe and the straight arm contacting the first straight section, and a diameter of the first through hole is larger than a total width of the first straight section and the straight arm contacting the first straight section.

7. The heat sink assembly as claimed in claim 5, wherein the through holes comprise a second through hole corresponding to each of the first curving portion and the second curving portion, and a diameter of the second through hole is larger than a width of each of the first curving portion and the second curving portion.

8. The heat sink assembly as claimed in claim 5, wherein the through holes comprise a third through hole corresponding to the connection portion of each of the first U-shaped heat pipe and the second U-shaped heat pipe, and a diameter of the third through hole is larger than a width of the connection portion of each of the first U-shaped heat pipe and the second U-shaped heat pipe.

9. The heat sink assembly as claimed in claim 1, wherein the first heat dissipating plate comprises a sidewall extending from the top surface and a height of the heat pipe module is substantially equal to a height of the sidewall.

10. The heat sink assembly as claimed in claim 9 further comprising a first reinforcing portion and a second reinforcing portion, the first reinforcing portion protrudes from the top surface of the first heat dissipating plate, and the second reinforcing portion is detachably positioned between the first heat dissipating plate and the second heat dissipating plate.

11. The heat sink assembly as claimed in claim 10, wherein a height of each of the first reinforcing portion and the second reinforcing portion is equal to or slightly larger than the height of the sidewall.

12. The heat sink assembly as claimed in claim 1, further comprising a plurality of fins attached to the second surface of the second heat dissipating plate.

13. A heat sink assembly, comprising:

a first heat dissipating plate;

a second heat dissipating plate;

a plurality of flat heat pipes horizontally positioned between the first heat dissipating plate and the second heat dissipating plate, the flat heat pipes defining an enclosed-space, wherein the enclosed-space is enclosed by the first heat dissipating plate and the second heat dissipating plate; and a plurality of through holes communicating with the enclosed-space, wherein the through holes are defined in at least one of the first heat dissipating plate and the second heat dissipating plate.

14. The heat sink assembly as claimed in claim 13, wherein the heat pipes comprise an S-shaped heat pipe and a first U-shaped heat pipe, the S-shaped heat pipe has two opposite recessed sides defining two openings, the first U-shaped heat pipe has a recessed side defining an opening, the recessed side of the first U-shaped heat pipe faces one of the two opposite recessed sides of the S-shaped heat pipe with the opening of the first U-shaped heat pipe communicating with one of the two openings of the S-shaped heat pipe to define the enclosed-space.

15. The heat sink assembly as claimed in claim 14, wherein the heat pipes further comprise a second U-shaped heat pipe having a recessed side defining an opening, and the recessed side of the second U-shaped heat pipe faces the other one of the two opposite recessed sides of the S-shaped heat pipe with the opening of the second U-shaped heat pipe communicating with the other opening of the two openings of the S-shaped heat pipe to define an additional enclosed-space.

16. The heat sink assembly as claimed in claim 15, wherein the S-shaped heat pipe comprises a first straight section, a second straight section, a third straight section, a first curving portion interconnected between the first and second straight sections, and a second curving portion interconnected between the second and third straight sections, each of the first and second U-shaped heat pipes comprises two straight arms and a connection portion interconnected between the two straight arms, and the first and second straight sections of the S-shaped heat pipe are respectively substantially parallel to and contact the two straight arms of the first U-shaped heat pipe.

17. The heat sink assembly as claimed in claim 16, wherein the second U-shaped heat pipe is positioned between the second straight section and the third straight section of the S-shaped heat pipe, one arm of the second U-shaped heat pipe is substantially parallel to and contacts the second straight section, and the other arm of the second U-shaped heat pipe is substantially parallel to and spaced from the third straight section.

18. The heat sink assembly as claimed in claim 17, wherein the through holes comprise a first through hole corresponding to the first straight section of the S-shaped heat pipe and the straight arm contacting the first straight section, and a diameter of the first through hole is larger than a total width of the first straight section and the straight arm contacting the first straight section.

19. The heat sink assembly as claimed in claim 17, wherein the through holes comprise a second through hole corresponding to each of the first curving portion and the second curving portion, and a diameter of the second through hole is larger than a width of each of the first curving portion and the second curving portion.

20. The heat sink assembly as claimed in claim 17, wherein the through holes comprise a third through hole corresponding to the connection portion of each of the first U-shaped heat pipe and the second U-shaped heat pipe, and a diameter of the third through hole is larger than a width of the connection portion of each of the first U-shaped heat pipe and the second U-shaped heat pipe.

* * * * *